United States Patent [19]

Barris et al.

[11] Patent Number: 5,053,062

[45] Date of Patent: Oct. 1, 1991

[54] CERAMIC FOAM PREFILTER FOR DIESEL EXHAUST FILTER SYSTEM

[75] Inventors: Marty A. Barris, Lakeville; Wayne M. Wagner, Apple Valley, both of Minn.

[73] Assignee: Donaldson Company, Inc., Minneapolis, Minn.

[21] Appl. No.: 411,311

[22] Filed: Sep. 22, 1989

[51] Int. Cl.[5] ..... F01N 3/02

[52] U.S. Cl. ..... 55/282; 55/466; 55/523; 55/DIG. 30; 60/311

[58] Field of Search ..... 55/282, 466, 523, DIG. 30; 60/311

[56] References Cited

U.S. PATENT DOCUMENTS

| | | | |
|---|---|---|---|
| 3,775,064 | 11/1973 | Berger et al. | 60/285 |
| 4,346,557 | 8/1982 | Shadman et al. | 55/523 |
| 4,427,418 | 1/1984 | Kogiso et al. | 55/287 |
| 4,456,457 | 6/1984 | Nozawa et al. | 55/283 |
| 4,505,106 | 3/1985 | Frankenberg et al. | 60/286 |
| 4,519,820 | 5/1985 | Oyobe et al. | 55/284 |
| 4,535,588 | 8/1985 | Sato et al. | 60/286 |
| 4,535,589 | 8/1985 | Yoshida et al. | 60/303 |
| 4,538,411 | 9/1985 | Wade et al. | 60/274 |
| 4,544,388 | 10/1988 | Rao et al. | 55/282 |
| 4,562,695 | 1/1986 | Rao et al. | 60/286 |
| 4,578,091 | 3/1986 | Borja | 55/90 |
| 4,581,891 | 4/1986 | Usui et al. | 60/311 |
| 4,615,173 | 10/1986 | Usui et al. | 55/466 |
| 4,622,051 | 11/1986 | Polach et al. | 55/417 |
| 4,631,076 | 12/1986 | Kurihara et al. | 55/283 |
| 4,662,911 | 5/1987 | Hirayama et al. | 55/282 |
| 4,686,827 | 8/1987 | Wade et al. | 60/286 |
| 4,744,216 | 5/1988 | Rao et al. | 55/466 |
| 4,744,217 | 5/1988 | Goerlich et al. | 55/DIG. 30 |
| 4,783,958 | 11/1988 | Borja | 60/274 |
| 4,810,273 | 3/1989 | Komoda | 55/487 |
| 4,851,015 | 7/1989 | Wagner et al. | 55/DIG. 30 |
| 4,867,768 | 9/1989 | Wagner et al. | 55/DIG. 30 |
| 4,878,928 | 11/1989 | Wagner et al. | 55/DIG. 30 |
| 4,881,959 | 11/1989 | Kono et al. | 55/267 |
| 4,899,540 | 2/1990 | Wagner et al. | 55/282 |

FOREIGN PATENT DOCUMENTS

| | | |
|---|---|---|
| 1-63719 | 4/1989 | Japan . |
| 1080618 | 5/1989 | Japan . |

*Primary Examiner*—Jay H. Woo
*Assistant Examiner*—C. Scott Bushey
*Attorney, Agent, or Firm*—Merchant, Gould, Smith, Edell, Welter & Schmidt

[57] ABSTRACT

A filter device for trapping particulates for diesel engine exhaust gases including an electrical heating element for regenerating the primary monolithic ceramic filter and a porous cermaic disc pre-filter between the heating element and the primary filter to provide a practical secondary source of heat when particulates on it combust during regeneration.

3 Claims, 2 Drawing Sheets

CERAMIC FOAM PREFILTER FOR DIESEL EXHAUST FILTER SYSTEM

FIELD OF THE INVENTION

The present invention is directed to systems for regenerating ceramic filters when used to remove particulates from gases, usually exhaust gases from diesel engines. More particularly, the invention is directed to a system with a pre-filter separating heating means from the primary ceramic filter.

BACKGROUND OF THE INVENTION

Governments are increasingly regulating the exhaust emissions of vehicles. In particular, vehicles powered by diesel engines must meet more and more stringent regulations in the next several years. Cellular ceramic filters have been recognized as being useful in trapping particulates from exhaust emissions. As the filters become clogged, however, they must be regenerated or an unacceptable back pressure develops. A number of positive regeneration systems are known.

The present invention is directed to a regeneration system of a type which uses an electric heater to provide heat for igniting soot or particulates at the inlet end of the monolithic ceramic filter. Once lighted, a flame front advances through the filter to burn away the particulates accumulated thereon. The problem with known systems is that, in general, they are not practical. Either components are designed which are so expensive that the systems are too costly for the consumer or the system has power requirements which would require a different electrical system than is presently available on vehicles, thereby again requiring cost which could not be paid by the consumer. There is, therefore, a need to develop a system which provides non-polluting filtering and regeneration at a power level and system cost which is practical.

SUMMARY OF THE INVENTION

The filter apparatus of the present invention has a housing and filtering mechanism including a ceramic filter element within a chamber of the housing. The apparatus also has mechanism for regenerating the ceramic filter element which includes mechanism for heating with a heating element the inlet face of the ceramic filter element. A porous ceramic disc pre-filter is supported by the housing between the heating element and the ceramic filter element. The regenerating mechanism further includes mechanism for blowing air through the heating element and the ceramic disc pre-filter toward the ceramic filter element to initiate and maintain regenerative combustion. There is control mechanism for the regenerating mechanism.

In another embodiment, a ceramic disc reradiator is supported by the housing between the heating element and the inlet to the housing. The pre-filter may be covered with an emissivity coating so that heat energy from the heating element is effectively absorbed and reradiated. Blowing air convectively helps move heat radiated away from the pre-filter toward the pre-filter. A high emissivity coating may also be applied to the side of the reradiator facing the heating element so that heat radiated in that direction is effectively reradiated back toward the pre-filter.

The benefits of using a disc pre-filter are multifold. First, the pre-filter removes larger debris from the exhaust system, such as oxide flakes which may be detrimental to trap longevity since iron deposits reduce ceramic strength. Also, the pre-filter collects other particulates and preferably has about a 10 percent efficiency when loaded. Thus, a pre-filter has protective and system efficiency enhancing functions.

Another benefit is that the pre-filter enhances regeneration characteristics of the trap system. Carbon collected on the pre-filter is ignited before the load on the primary ceramic filter element ignites. The heat released by the combustion taking place on the pre-filter is radiated and otherwise moved to the primary filter with the aid of the small convective flow of blowing air. If it is assumed, for example, that the energy of combustion equals the energy gain of the ceramic disc pre-filter (for simplicity sake), then a calculation of thermal gain can be made on considering: change in enthalpy of carbon equals 7918 cal/gm; 5 hours of filtering at 15 gm/hr at 8 percent efficiency equals 7.2 gm collected; mass of pre-filter estimated at 25 percent solidity, 2.5 gm/cm$^3$ density; disc dimensions of 10.5 inch diameter by 0.5 inch thickness equals 443 in$^3$; average specific heat of ceramic equals 0.25 cal/gm° C.; so that 7.2 gm releases 57 kcal which heats 443 in$^3$ of ceramic by 55° C. Thus, assuming most of the heat is radiated and convected to the primary ceramic filter element, the inlet face therefore receives the benefit of a faster temperature rise (up to 55° C. for the example given) during the preheating stage.

Additionally, it is preferable to place the pre-filter in close proximity to the primary filter. It is also preferable to place the heating element close to the pre-filter and the reradiator close to the heating element. In this way, particularly for horizontally oriented systems, the pre-filter and the reradiator reduce the natural tendency of heated air to rise. Thus, heat is transferred vertically more uniformly to the inlet face of the primary ceramic filter element.

Finally, a disc pre-filter and/or a disc reradiator separately mounted on either side of and spaced from a heating element are more practical than embedding a heating element in ceramic material with the combination being used as a heater to ignite collected soot on a primary ceramic filter. The separately mounted discs are much less expensive to make and to assemble to the housing. The separate mounting provides a more stable mechanical attachment with less likelihood of mechanical breakage than an assembly having an embedded heater. Furthermore, separately mounted discs avoid the problem of different thermal expansion of any heating element and surrounding ceramic thereby eliminating breakage due to dissimilar expansion rates. Thus, the present invention is not only less expensive to make and assemble, but lasts longer.

Advantages therefore include reduced buoyancy effect (i.e., inhibiting vertical flow of heated air in a horizontally mounted system), faster heat up of the primary filter, more uniform regeneration temperatures at the face of the primary filter, improved collection of carbon, protection from debris flakes, more uniform operation of the heating system, and less expensive manufacture and assembly, as well as longer lifetime.

These advantages are better understood by reference to the drawings briefly described hereinafter and the detailed description of the invention following thereafter.

DETAILED DESCRIPTION OF THE PREFERRED EMBODIMENT

Figure 1:
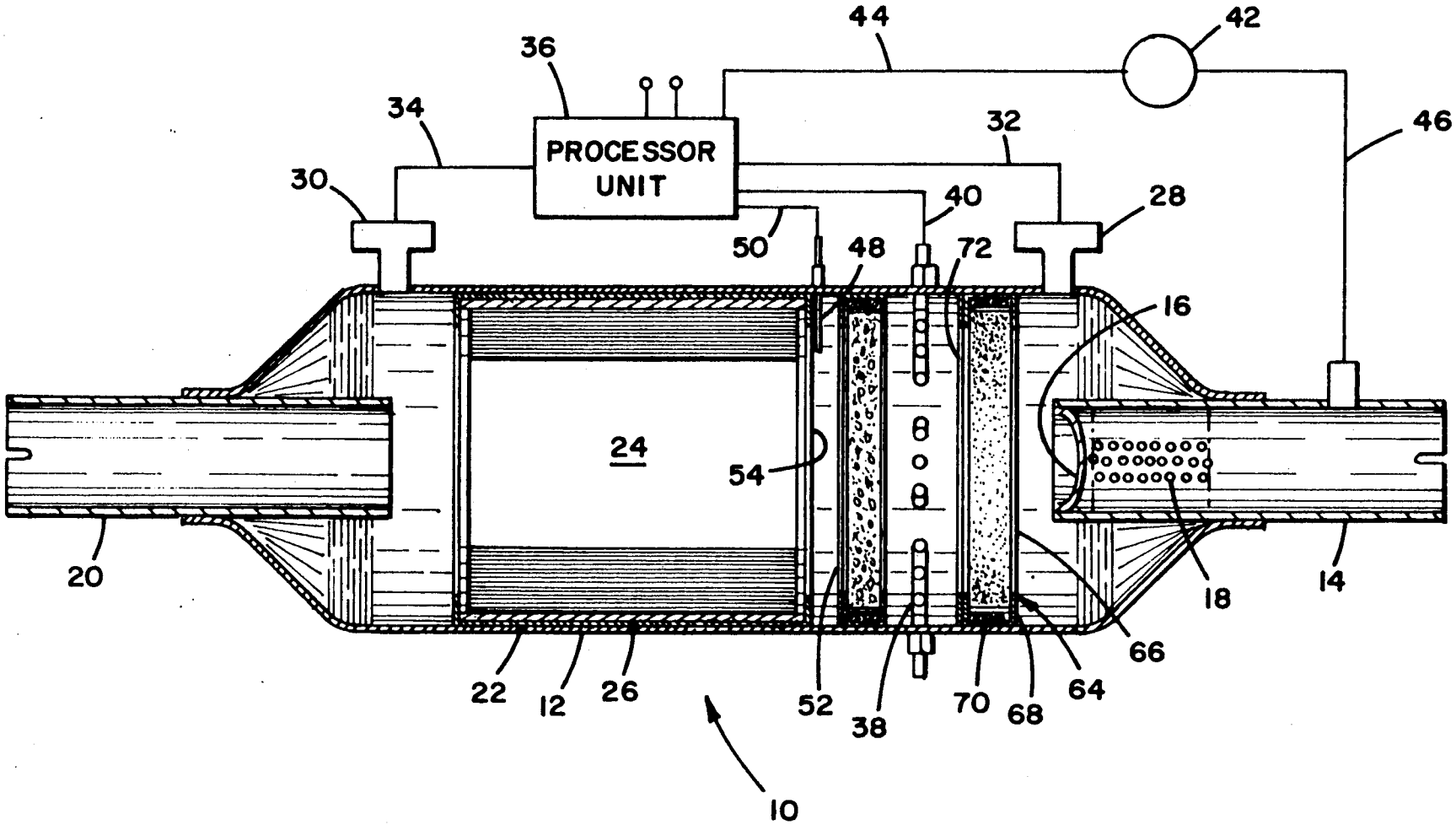
FIG. 1 is a cross-sectional view of filter apparatus for removing particulates from engine exhaust gases and which includes pre-filter and reradiator apparatus in accordance with the present invention.

In reference to the drawings, like reference numerals throughout the several views designate identical or corresponding parts. In this regard, a typical regenerative filtration device for exhaust gases of an engine, particularly a diesel engine, is shown in FIG. 1. Device 10 includes a housing 12 which is substantially cylindrical and has narrowed ends. An inlet pipe 14 is received at one end of housing 12. Inlet pipe 14 has a closed outlet end 16 and openings 18 to allow exhaust gas to expand from inlet pipe 14 into the entry portion of the chamber formed by housing 12. An outlet pipe 20 is received at the other end of housing 12.

A monolithic ceramic filter is mounted in a can 22 tack welded or otherwise affixed to housing 12. Can 22 has in turned ends to retain filter 24 therein. A heat resistant mat 26 provides insulation and cushioning between filter element 24 and can 22. A gasket may be used between the filter element and the can at the ends of the mat. A ceramic filter 24 of the type useful with respect to the present invention is commercially available from Industrial Ceramics Department, Ceramic Products Division, Corning Glass Works, Corning, N.Y. 14830. In addition, any fuller discussion of the use of this type of ceramic filter with respect to a regenerative exhaust filtering system may be found in U.S. Pat. No. 4,851,015, incorporated herein by reference.

The back pressure to the engine or some kind of differential pressure monitoring system determines when filter 24 is loaded to a level which requires regeneration. Pressure sensors 28 and 30 illustrate such a sensing mechanism and are wired via lines 32 and 34 to a processor unit 36. At the appropriate predetermined time, processor unit turns on electric heater 38 via line 40. Also, a blower 42 is turned on via line 44 to direct air therefrom through line 46 into the entry portion of the chamber enclosed by housing 12. A thermocouple 48 monitors temperature and provides information via line 50 to processor unit 36.

A porous ceramic foam disc 52 is mounted between the inlet face 54 of filter 24 and heating element 38. Disc 52 is shown for clarity purposes to be rather widely spaced with respect to filter 24 and heating element 38. Preferably, however, disc 52 is in close proximity with the inlet face 54 of filter 24. In this regard, provision must be made to allow proper operation of thermocouple 48. Also, preferably, heating element 38 is in close proximity to pre-filter 52.

Figure 2:
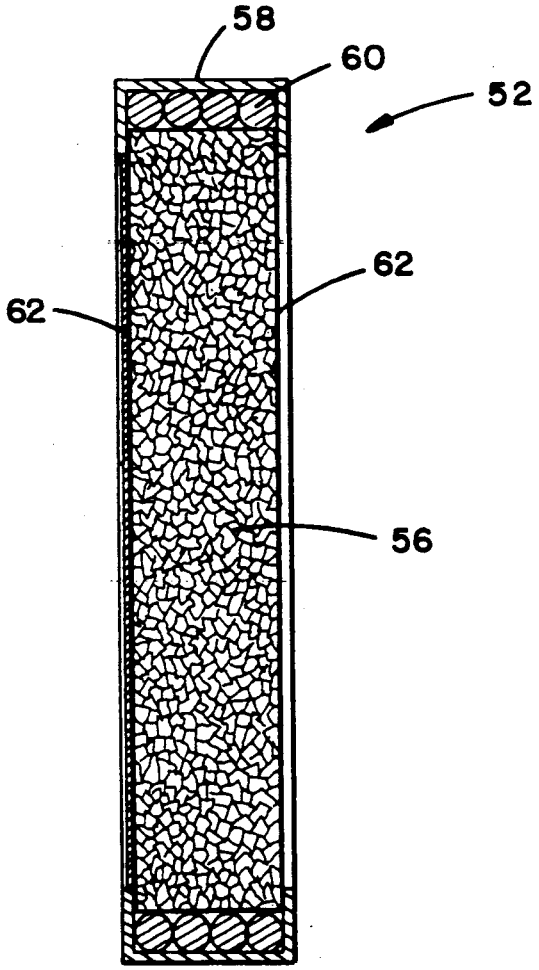
FIG. 2 is a cross-sectional view of a pre-filter in accordance with the present invention.

Pre-filter 52 is shown in more detail in FIG. 2. A ceramic disc 56 is held by cylindrical channel 58 tack welded or otherwise affixed to housing 12. A fiberglass rope 60 or other sealing and cushioning gasket-like material is fitted between disc 56 and channel 58. Although not necessary, a high emissivity coating 62 is preferably applied to both sides of disc 56. The coating should have an emissivity value greater than 80%. A representative coating known as silicon carbide is commercially available from High-Tech Ceramics, Inc., P. 0. Box 1105, Alfred, N.Y. 14802.

In a test, disc 56 was made of lithium alumina silicate having a thickness of one half inch and a porosity of approximately 10 pores per inch. Acceptable material may be obtained commercially from High-Tech Ceramics, Inc. The porosity of the disc should be between 10 and 40 pores per inch. The pre-filter, when loaded, should have about a 10 percent efficiency, with a lesser efficiency when cleaned or regenerated. It is understood that the pre-filter could as well be made of different materials, e.g., cordierite, mullite, etc.

In operation, exhaust gases flow through heating element 38 and pre-filter 52 to filter element 24. Pre-filter 52 removes any larger debris and flakes from the gas flow and also removes some particulates providing preferably about a 10 percent efficiency when filter element 24 is ready for regeneration. The pre-filter efficiency would be less at a time before filter element 24 requires regeneration. At the time of regeneration, since pre-filter 52 is located between heating element 38 and inlet face 54 of filter element 24, the articles collected on pre-filter 52 are heated more rapidly than those on filter element 24. As a consequence, the particles on pre-filter 52 ignite first and provide a further heat source for filter element 24. Pre-filter 52 when ignited heats filter element 24 in large measure through radiation. However, since a low flow of air is flowing from fan 42 during regeneration, much of the heat which radiates away from inlet face 54 tends to be convectively conveyed back to filter element 24 and thus also heats filter element 24 through this mechanism. Thus, the presence of pre-filter 52 at the location indicated provides an element, like the head of a match stick, adjacent to the heating element which is easier to ignite than the soot on filter element 24 and, when ignited, provides more heat, more rapidly, to filter element 24 than would otherwise be the case. As a consequence, the energy which must be supplied by a vehicle electrical system to power the regeneration apparatus need not provide as much power as would otherwise be necessary. Hence, the presence of pre-filter 52 of a type as specified leads to a more practical regeneration system for a ceramic filter element used to filter particulates from diesel exhaust gases.

As indicated previously, pre-filter 52 provides the further benefit of inhibiting a vertical flow or a rising of heated air between heating element 38 and inlet face 54 of filter element 24 since the porosity of the ceramic inhibits such vertical flow when device 10 is oriented horizontally.

The high emissivity coating provides a still further benefit in that heat is more efficiently absorbed and reradiated. Since the flow of air is from the inlet end of device 10 toward filter element 24, radiated heat from the downstream side of pre-filter 52 is directed toward inlet face 54. Heat radiated in the other direction is primarily absorbed in air which flows toward filter element 24. Thus, most of the heat generated by particulates burning on pre-filter 52 is ultimately directed toward filter element 24.

It may also be desirable in many applications for device 10 to include a porous ceramic disc reradiator 64 as shown in FIG. 1 supported by housing 12 between inlet pipe 14 and heating element 38. Reradiator 64 is shown separated a fairly wide distance from heating element 38 in FIG. 1, but preferably is in close proximity thereto. Reradiator 64 includes a porous ceramic disc 66 of a material the same as or substantially similar to disc 56. Disc 66 is held by cylindrical channel 68 tack welded or otherwise affixed on housing 12. A fiberglass rope 70 or other sealing and cushioning gasket-like material is fitted between disc 66 and channel 68. Preferably, a black or other high emissivity coating like that disclosed above is applied to the downstream face 72 of disc 66 so that heat from heating element 38 is readily reradiated back toward pre-filter 52. Details with respect to a reradiator 64 are provided in greater depth in U.S. Pat. No. 4,878,928 which is assigned to the assignee of the present application and hereby incorporated by reference.

In operation, reradiator 64 also collects some particulates from the exhaust gas stream. During regeneration, the particulates ignite and burn in a fashion similar to those collected on pre-filter 52. Such combustion provides still a further source of heat which is radiated toward pre-filter 52 or is carried convectively by the flow of air from fan 42. Thus, the combination of a pre-filter and a reradiator serve not only to direct most of the heat energy of heating element 38 eventually toward filter element 24, but also provide further exothermal sources of heat energy which gets directed toward filter element 24.

Thus, the present invention has been described in detail. It is understood, however, that the disclosure is representative and that equivalents are possible.

Consequently, changes made, especially in matters of shape, size, and arrangement are within the principle of the invention to the full extent extended by the meaning of the terms in which the appended claims are expressed.

What is claimed is:

1. Filter apparatus for reducing particulates from exhaust gases from an engine, comprising:

a housing have a chamber with an inlet, an outlet, and a fluid flow path leading from said inlet upstream to said outlet downstream;

means, within said chamber along said fluid flow path, for filtering the particulates from said exhaust gases, said filtering means including a ceramic filter element having an inlet end;

means for regenerating said ceramic filter element, said regenerating means including means for heating said ceramic filter element, said heating means having a heating element supported by said housing;

a porous ceramic disc pre-filter between said heating element and said ceramic filter element, said disc pre-filter being spaced from said heating element, said disc pre-filter being supported by said housing;

a porous ceramic disc reradiator between said inlet to said chamber and said heating element;

said regenerating means including means for blowing air through said heating element and said ceramic disc pre-filter toward said ceramic filter element to initiate and maintain regenerative combustion; and means for controlling said regenerating means.

2. The apparatus in accordance with claim 1 wherein said reradiator and said pre-filter both have a porosity ranging from 10 to 40 pores per inch.

3. Filter apparatus for reducing particulates from exhaust gases from an engine, comprising:

a housing having a chamber with an inlet, an outlet, and a fluid flow path leading from said inlet upstream to said outlet downstream;

means, within said chamber along said fluid flow path, for filtering the particulates from said exhaust gases, said filtering means including a ceramic filter element having an inlet end;

means for regenerating said ceramic filter element, said regenerating means including means for heating said ceramic filter element, said heating means having a heating element supported by said housing;

a porous ceramic disc pre-filter between said heating element and said ceramic filter element, said disc pre-filter being spaced from said heating element, said pre-filter having opposite sides covered with a coating have an emissivity greater than 80%, said disc pre-filter being supported by said housing;

said regenerating means including means for blowing air through said heating element and said ceramic disc pre-filter toward said ceramic filter element to initiate and maintain regenerative combustion; and means for controlling said regenerating means.

* * * * *